US006154024A

United States Patent [19]

Lewandowski et al.

[11] Patent Number: 6,154,024

[45] Date of Patent: Nov. 28, 2000

[54] METAL IMMUNE MAGNETIC TRACKER

[75] Inventors: Ronald J. Lewandowski, Minnetonka; Emmet J. Wier, St. Louis Park, both of Minn.

[73] Assignee: Honeywell, Inc., Morristown, N.J.

[21] Appl. No.: 09/083,729

[22] Filed: May 22, 1998

[51] Int. Cl.[7] ..... G01B 7/004

[52] U.S. Cl. ..... 324/207.12; 324/207.17; 702/95; 702/152

[58] Field of Search ..... 324/207.12, 207.17, 324/225; 342/448; 702/95, 152, 153

[56] References Cited

U.S. PATENT DOCUMENTS

| | | | |
|---|---|---|---|
| 4,287,809 | 9/1981 | Egli et al. | 89/41 EA |
| 4,688,037 | 8/1987 | Krieg | 340/825.72 |
| 4,829,250 | 5/1989 | Rotier | 324/225 |
| 4,849,692 | 7/1989 | Blood | 324/208 |
| 5,347,289 | 9/1994 | Elhardt | 342/448 |
| 5,373,857 | 12/1994 | Travers et al. | 128/782 |
| 5,833,608 | 11/1998 | Acker | 600/409 |

FOREIGN PATENT DOCUMENTS

| | | | |
|---|---|---|---|
| 0691547 | 1/1996 | European Pat. Off. | G01R 33/025 |
| 0745827 | 12/1996 | European Pat. Off. | F41G 3/22 |
| 9200529 | 1/1992 | WIPO | G01S 3/14 |

*Primary Examiner*—Christine K. Oda
*Assistant Examiner*—Henry S. Andersen
*Attorney, Agent, or Firm*—Kris T. Fredrick

[57] ABSTRACT

A head mounted tracker is placed in the operator area near the operator. The tracker has the capability to map the operator area without manual assistance. These operations are performed by processing low and high frequency components, based on the frequency of an alternating current generating the magnetic field, of the magnetic field in the operator area.

5 Claims, 2 Drawing Sheets

METAL IMMUNE MAGNETIC TRACKER

BACKGROUND OF THE INVENTION

This invention relates to a magnetic tracker for tracking the orientation and position of a helmet used by vehicle operators in such vehicles as tanks, planes, etc. Trackers are well known in the present area of technology and the operation of a tracker is described in references U.S. Pat. No. 4,287,809 by Egli et al, U.S. Pat. No. 4,945,305 by Blood, and U.S. Pat. No. 3,868,565 by Kuipers. However, metal fixed in the operator area can provide erroneous values so that an accurate reading of the correct position and orientation of the operator cannot be made.

Presently, a known method to take care of this problem is to map the electromagnetic effects of metal in the operator area. Mapping is representing the magnetic field with a mathematical model. The magnetic field of the area is mapped and the data is used by the tracker to compute accurate position and orientation. Mapping is very cumbersome. It takes a great amount of time and requires numerous pieces of equipment and personnel to map the area correctly. This costs time and money. It would be beneficial to find a way to improve upon the current methods so that time can be saved as well as equipment and personnel.

SUMMARY OF THE INVENTION

A metal immune tracker is disclosed including an apparatus attached to an operator for receiving a very low frequency component and a high frequency component of the magnetic field in the operator area and a processor which processes the very low and high frequency components to map the operator area mathematically.

BRIEF DESCRIPTION OF THE PRESENT INVENTION

DETAILED DESCRIPTION OF THE PRESENT INVENTION

Figure 1:
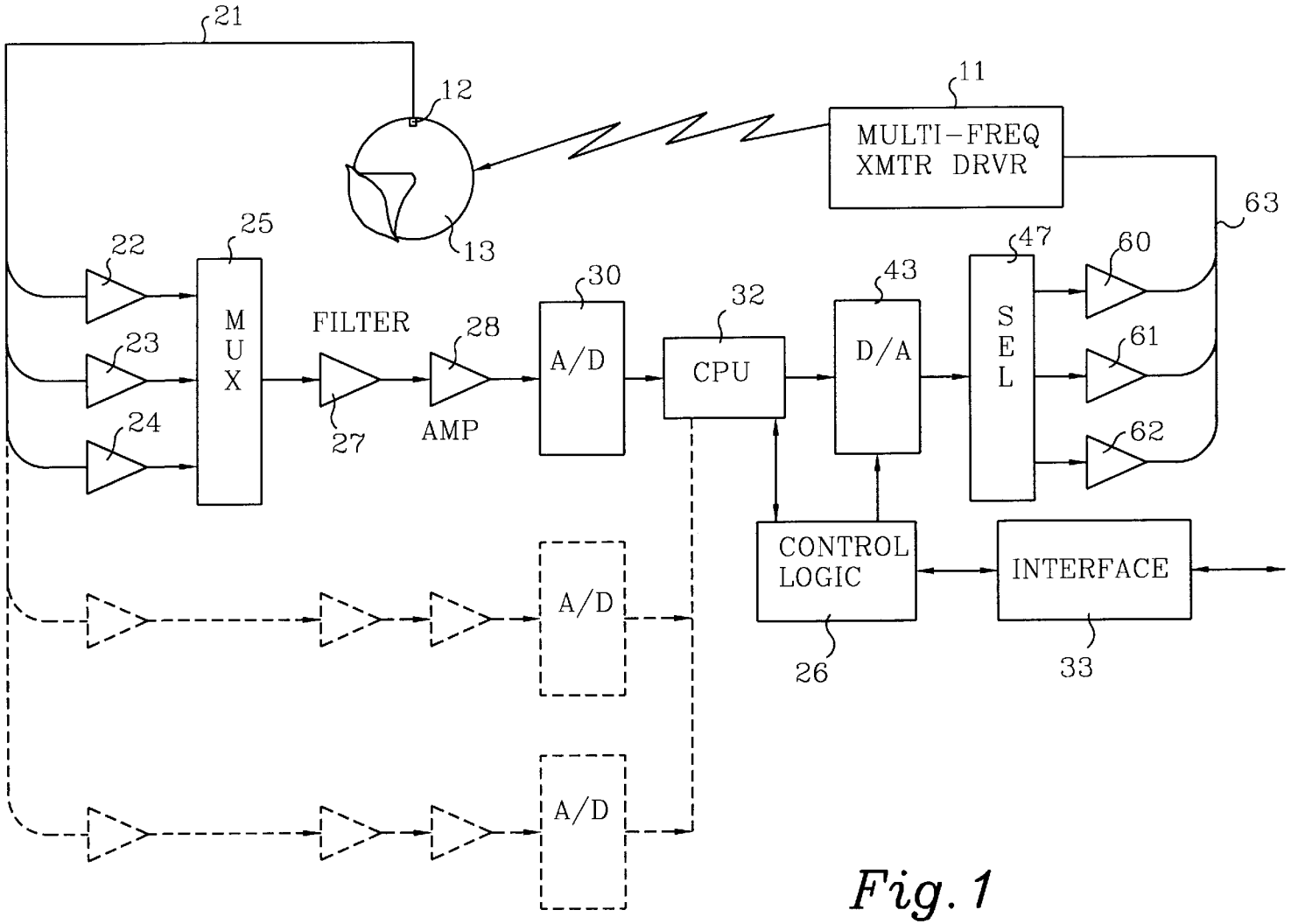
FIG. 1 shows a metal immune tracker of the present invention.

The present invention combines a very low frequency (vlf) component with a high frequency (hf) component of a magnetic field so that a tracker system will be metal immune. FIG. 1 shows a block diagram of the invention. A receiver 12 is mounted on a helmet 13. The receiver 12 is what receives the electromagnetic information such as the very low frequency component and the high frequency component of the magnetic field in the operator area. The receiver 12 is typically attached to the operator's helmet 13 so as the helmet 13 moves, the receiver 12 will receive the information required to determine the helmet 13 position and orientation. This operation allows metal immune operation or self mapping so that it is not required to map out the area with excess equipment or personnel. This operation also saves the time of performing manual mapping. Some examples of a receiver 12 would be a flux gate magnetometer or a solid state sensor which are both well known in this area of technology.

Once the components of the magnetic field are obtained, it will be necessary to perform calculations on the very low frequency component and high frequency component so that previous data is replaced with the corrected data. As a result, the data is sent from the receiver 12 to pre-amplifiers 22, 23, 24 via cable 21. The reason for three preamplifiers 22, 23, 24 is to accommodate for the x, y, and z signals for the helmet movements and to amplify the signals for processing. The output of the pre-amplifiers 22, 23, 24 are sent to a multiplexer 25 to combine the three signals. The output of the multiplexer 25 is filtered by a bandpass filter 27 to filter out unwanted frequencies. This signal is then amplified by a variable gain amplifier 28. The output from the variable gain amplifier 28 is sent to an analog-to-digital converter 30 whose output is sent to a central processing unit (CPU) 32. As can be seen in FIG. 1, a single A/D converter can be used with a multiplexer to process all three input signals or separate A/D converters can be used to process each input signal. The plurality of this set up would be only to increase the speed for processing, but would not fundamentally affect how the present invention operates.

The CPU 32 performs the calculations of combining the very low frequency component with the high frequency component to obtain an accurate mapping of the operator area. More details regarding the CPU's computations involved in the mathematical mapping of the area will be discussed in the description of FIG. 2.

A magnetic field is generated with very low frequency and high frequency components by the control logic 26, D/A converter 43, and is eventually transmitted by the multi-frequency transmitter driver.

The control logic 26 used is similar to the control logic used in the Egli reference mentioned in the Background of the Invention and will not be discussed in any further detail presently. If further detail of the control logic is required, the Egli reference provides proper detail.

A selector switch 47 is used to control the transmission of the signals to the transmitter 11 by selecting which signal will be sent. The signals are sent through amplifiers 60, 61, and 62 so that the signals have sufficient power for energizing the transmitter 11. The transmitter 11 transmits a magnetic field in the operator area back to the helmet 13. The transmitter sends a magnetic field with both a high frequency component, which allows rapid dynamic response, and a very low frequency component, which is not affected by metal structures in the operator area.

Orientation and position information is sent back to the vehicle systems via the interface 33 so that the vehicle operates accordingly with the information. One such example would be to control the instrumentation of an aircraft of which it is connected with. Again, the interface 33 used is similar to the interface used in the Egli reference mentioned in the Background of the Invention and will not be discussed in any further detail presently. If further detail of the interface is required, the Egli reference provides proper detail.

Figure 2:
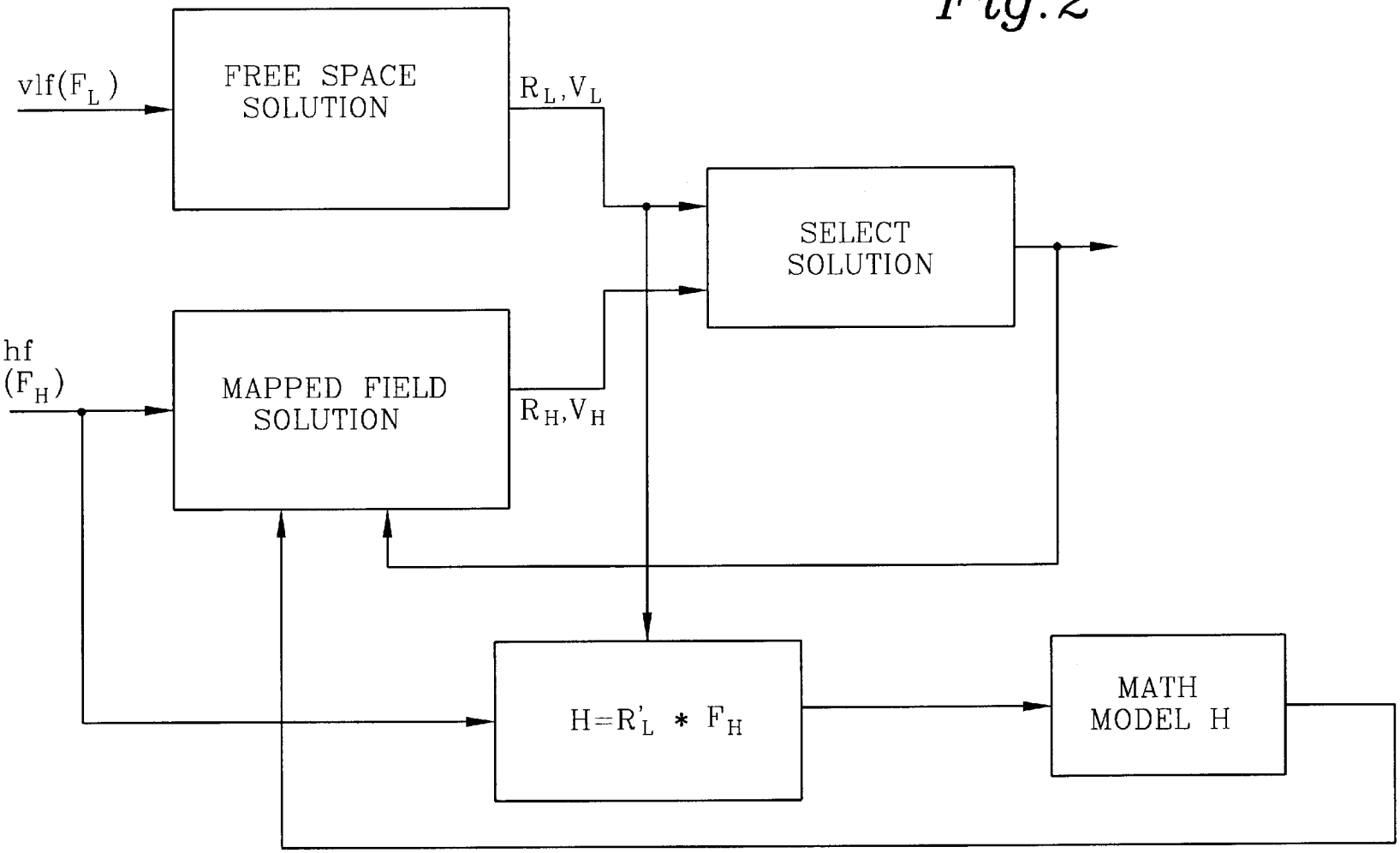
FIG. 2 shows the calculations performed in the processing unit of the present invention.

Another aspect of the present invention is the ability for self mapping. FIG. 2 shows a block diagram of the calculations performed for self mapping. The present invention automatically maps as the operator moves his head around. The operator could also move his head in a methodical area to cover the entire operator area. If all areas are not covered, the mapping will display the area and give cues to the operator to some unmapped areas. The operator merely would need to move his head in those areas so that fill coverage could be achieved. As a result, the more the operator moves his head, the greater the area that will be mapped. With continued use, the entire operator area will be adequately mapped.

As mentioned before, the vlf and hf are sensed and to be combined for the present invention. In order for this to happen, the vlf and hf must be converted into mathematical data to be computed in the CPU 32 so that the area can be mapped.

The vlf solution is shown by $R_L$ and $v_L$ where R is the rotation orientation and v is the vector position. The very low frequency data is used for many reasons. Firstly, the very low frequency data is used in tracking to determine exact position and orientation. This is well known in this area of technology and no further discussion will be provided in this area. Also, the vlf is used because non-ferrous metal does not affect very low frequency and thus, is metal immune. The hf is used on the other hand due to the higher update rate possible to provide better dynamic response.

A free space solution would be used to derive the $R_L$ and $v_L$ for the vlf. The free space solution is well known in this area of technology. One embodiment of a free space solution is as follows. It is to be noted that the present invention is not limited to the disclosed solution, but that the following is a description of the preferred embodiment of the present invention. The free-space solution is derived from dipole physics and is described briefly below. In all of the calculations, the superscript $^T$ represents the transpose of the preceding matrix or vector. The vlf field matrix ($F_L$) is composed of three column vectors, each consisting of three components in the receiver coordinate frame, resulting from the three independent field transmissions. The scalar for field normalization is computed by:

$$ginv=(6/\text{trace}\ [F_L{}^TF_L])^{1/2}$$

The field matrix is then normalized by:

$$F_N=-ginv\ F_L$$

The square of the dipole matrix is computed by:

$$M^2=F_N{}^TF_N$$

The matrix A is then computed by:

$$A=(M^2-I)/3$$

where I is the 3×3 identity matrix. The elements in each of the three rows of A are added together to become:

$$w(1)=A(1,1)+A(1,2)+A(1,3)$$
$$w(2)=A(2,1)+A(2,2)+A(2,3)$$
$$w(3)=A(3,1)+A(3,2)+A(3,3)$$

If A(1,2)<0 then set w(2)=−w(2)
If A(1,3)<0 then set w(3)=−w(3)
The column vector W is assembled:

$$W=[w(1)\ w(2)\ w(3)]^T$$

The column vector V is computed:

$$V=AW$$

The magnitude of V is then computed to be:

$$V_N=(v(1)^2+v(2)^2+v(3)^2)^{1/2}$$

V is normalized to get the unit direction vector from transmitter to receiver $$U=V/V_N$$

The inverse of the dipole matrix is computed:

$$M^{-1}=I-(U\ U^T)3/2$$

where U $U^T$ is the vector outer square of the direction vector. The Euler rotation matrix of the receiver is computed by:

$$R=F_NM^{-1}$$

The rotation matrix is orthogonalized:

$$R_L=R(3I-R^TR)/2$$

The range vector from transmitter to receiver is computed by:

$$V_L=(ginv)^{1/3}U$$

The components of the range vector are the Cartesian coordinates of the receiver (x, y, and z). Finally, the Euler angles are computed to create a free space solution with:

$$az=\text{arctan}\ [R_L(1,2)/R_L(1,1)]$$

$$el=\text{arctan}\ [-R_L(1,3)/\{R_L(1,1)^2+R_L(1,2)^2\}^{1/2}]$$

$$rl=\text{arctan}\ [R_L(2,3)/R_L(3,3)]$$

where az, el, and rl are the azimuth, elevation, and roll angles of the receiver relative to the transmitter A tracking algorithm based on a mapped field solution is used for the hf. The mapped field solution of the hf field uses a nonlinear least-squares (NLS) tracking algorithm. These algorithms are well known in parameter estimation theory. See for example, chapter 2, section E, of "Parameter Estimation" by Harold W. Sorenson, copyright 1980 by Marcel Dekker, Inc. In the application of the NLS algorithm to the magnetic tracker problem, mathematical models of the magnetic field and the gradient of the magnetic field with respect to the position and orientation variables are required. The field mapping process provides the data needed to generate these math models. Linear regression techniques are easily applied to the mapping data to obtain the polynomial coefficients. By choosing polynomials in x, y, and z to model the field in primary coordinates, the gradient of the field is readily determined. The gradient can easily be rotated into the receiver frame and gradients with respect to the Euler angles can be included into the model. It should be noted that there are math models other than polynomials that could be used, but the present invention is not limited to the following description which is merely an explanation of the preferred embodiment.

Let the receiver position and orientation be represented by a six element state vector s=[x y z az el rl]$^T$, where the superscript T represents the transpose of the row vector. Let the field sensed by the receiver be represented by the 9×1 column vector (f) whose first three elements represent the first sensed vector, the next three are the second sensed vector, and the last three represent the last sensed vector. Each sensed vector results from an independent transmitted field vector. Let g be a 9×1 column vector representing the math model of f. Let A represent the transpose of the matrix obtained by computing the gradient with respect to s of the transpose of g. A is 9×6 and will be referred to as the gradient matrix. Let P represent the pseudo inverse of A: P=$[A^TA]^{-1}A^T$. Finally, let $s^*_n$ represent our last estimate of s, then our next estimate is obtained from: $s^*_{n+1}=s^*_n+k\ P(s^*_n)[f(s)-g(s^*_n)]$. This procedure, applied iteratively, provides a least-squares estimate of the state vector (s). The parameter (k) has a value less than or equal to 1 and is a step size parameter that influences the rate of convergence of the iterations. The initial estimate of s is obtained from the free-space solution of the vlf field. The first time the hf and vlf are run through these mathematical computations, the $R_L$ and $v_L$ values are used to initialize the tracking algorithm as a point of reference since the vlf is more accurate. However, in computing the $R_H$ and $v_H$ of the hf field, polynomials need to be computed by mapping. The term mapping refers to the process of measuring the high frequency field throughout the operational volume. This requires measuring the high frequency field at known positions and orientations relative to the primary or reference coordinate frame. Once these measurements are made, a mathematical model can be generated that describes the field as a function of position (x, y, z) and orientation (az, el, rl). The position variables are Cartesian coordinates relative to the primary reference frame and the orientation variables are the Euler angles of the receiver with respect to the primary reference frame.

The normal mapping process involves placing the receiver on a XYZ motion control fixture and aligning the fixture in the cockpit such that the linear axes of motion are parallel with the primary reference coordinate frame. The receiver orientation is fixed at known angles. A linear motion controller is used to step through the entire operational volume, in small increments, and the high frequency field is measured at each increment. The x, y, z linear positions at each increment are obtained from the motion controller.

The self-mapping process of the present invention does not use a motion control fixture to position the receiver. Instead, it uses the rotation matrix and linear translation of the magnetic receiver obtained from the free-space solution of the very low frequency field matrix. The very low frequency field matrix is free of eddy current distortion and provides accurate position and orientation. The vlf and hf field data are time stamped so that the output of the vlf solution can be associated with the corresponding hf field data. In this way, mapping data can be acquired while the operator is using the system in the normal manner. The data is acquired automatically each time a vlf solution is available and the angular and linear translation rates of receiver motion are small.

The Euler rotation matrix from the vlf solution ($R_L$) is used to rotate the hf field matrix from the receiver reference frame to the primary reference frame:

$$H=(R_L)^{T*}\ F_H$$

Where H is the hf field matrix in primary coordinates, $R_L$ is the rotation matrix of the receiver obtained from the vlf solution, T represents the matrix transpose of $R_L$, and $F_H$ is the measured hf field matrix. A mapping data point consists of the position vector $V_L$=(x, y, z) obtained from the vlf free-space solution and the rotated field matrix (H). This data is sorted into predefined 3-dimensional cells. When enough data is available in a cell, the coefficients of a polynomial describing H throughout the cell can be computed. The computation of the coefficients is accomplished using linear regression. The resulting polynomial model minimizes the error over all of the points in the cell in a least-squares sense. This model is then used in future hf tracking solutions. Polynomials will be produced with what the field should look like with respect to the position. These polynomials are sent back to the tracking algorithm and $R_H$ and $v_H$ are computed. Even after all of the predefined cells have enough data to produce accurate polynomial fits, data can continue to be added by overwriting previous data, thereby updating the model to represent the latest configuration of the cockpit and resulting hf field. Hence, the model automatically adapts to changes in the metal configuration in the cockpit. For this reason, it is said to be metal immune.

A vlf or hf solution is selected in the central processing unit 32. The vlf solution is elected for initialization, re-establishment of tracking anytime tracking is interrupted, or large changes in the hf solution. The reason for this selection is because the vlf solution is more stable than the hf solution. The hf solution is selected the rest of the time.

Certain solutions are known in this area of technology to combine both the vlf and hf solution. One such method is Kalman filtering. Another method is using a free space algorithm or characterized fields algorithm to generate mapping data. These algorithms map the magnetic field and generate an algorithm based on the map. After the first computations are performed, the output of the select solution is used to reinitialize the tracking algorithm. As mentioned before, the tracking algorithm requires initialization in order to perform accurate calculations. This data then leaves the CPU 32 and goes through various other operations as described above in the description for FIG. 1. Ultimately, this data will map the pilot area and allow the area to be metal immune.

The invention has been described herein in detail in order to comply with the Patent Statutes and to provide those skilled in the art with the information needed to apply the novel principles and to construct and use such specialized materials and components as are required. However, it is to be understood that the invention can be carried out by specifically different materials and components, and that various modifications, both as to the processing details and operating procedures, can be accomplished without departing from the scope of the invention itself.

What is claimed is:

1. A tracker residing in an operator area, comprising:

a receiver attached to a helmet an operator is wearing wherein the receiver receives high frequency and very low frequency information of a magnetic field in the operator area as the operator moves his or her head; and processing means, connected to the receiver, to mathematically map the area the operator is operating in based on a combination of the high frequency and very low frequency information received from the receiver.

2. The tracker of claim 1, wherein the apparatus is a flux gate magnetometer.

3. The tracker of claim 2, wherein the apparatus is a solid state sensor.

4. The tracker of claim 3 wherein the solid state sensor is magnetoresistive.

5. A method of creating a metal immune tracker, comprising the steps of:

receiving a very low frequency component of the magnetic field in an area to be tracked;

receiving a high frequency component of the magnetic field in the area to be tracked;

selecting between the high frequency component and the very low frequency component to matchematically map the area to be tracked;

fitting the selected component into a mathematical model designating part of the area to be tracked; and combining the selected high frequency components with the selected very low frequency components into a mathematical model representing a map of the area to be tracked.

* * * * *